US005083683A

United States Patent [19]

Knickerbocker

[11] Patent Number: 5,083,683

[45] Date of Patent: Jan. 28, 1992

[54] FINGERTIP SPRAYER MOUNTED ON AN ANGLED NECK CONTAINER

[75] Inventor: Michael G. Knickerbocker, Upland, Calif.

[73] Assignee: Calmar Inc., Watchung, N.J.

[21] Appl. No.: 618,683

[22] Filed: Nov. 26, 1990

[51] Int. Cl.[5] ..... B67D 5/40; B67D 5/60

[52] U.S. Cl. ..... 222/382; 222/321; 222/464; 222/383; D9/300; D9/373

[58] Field of Search ..... 222/207, 211, 320, 321, 222/323, 372, 377, 381, 382, 383, 385, 402.1, 464; D9/300, 373, 374, 404

[56] References Cited

U.S. PATENT DOCUMENTS

| | | | |
|---|---|---|---|
| D. 244,991 | 7/1977 | Weckman et al. | 222/383 X |
| D. 310,169 | 8/1990 | Kowollik et al. | D9/300 X |
| 1,118,977 | 12/1914 | Watrous | 222/383 X |
| 1,530,074 | 3/1925 | Eckert | 222/382 X |
| 2,760,687 | 8/1956 | Spier et al. | 222/180 |
| 3,301,438 | 1/1967 | Tillotson | 222/464 X |
| 3,583,609 | 6/1971 | Oppenheimer | D9/300 X |
| 3,618,829 | 11/1971 | Elmore et al. | 222/320 X |
| 4,830,235 | 5/1989 | Miller | 222/464 |
| 4,925,063 | 5/1990 | Ali et al. | 222/563 X |

FOREIGN PATENT DOCUMENTS

| | | | |
|---|---|---|---|
| 3829962 | 5/1989 | Fed. Rep. of Germany | 222/464 |
| 867904 | 5/1961 | United Kingdom | 222/464 |

*Primary Examiner*—Kevin P. Shaver
*Attorney, Agent, or Firm*—Watson, Cole, Grindle & Watson

[57] ABSTRACT

A manually operated pump dispenser assembly includes a container having an angled neck at its top opening and a pump dispenser mounted on the neck. The container neck and sprayer have a central axis lying at an acute angle to the central axis of the container. The neck axis intersects the container wall, and a dip tube suspended from the sprayer lies along such axis and extends into an interior corner of the container. Such interior corner forms a well from which substantially the entirety of contents of the container is capable of dispensed upon actuation of the dispenser while holding the container with the neck axis substantially upright.

8 Claims, 3 Drawing Sheets

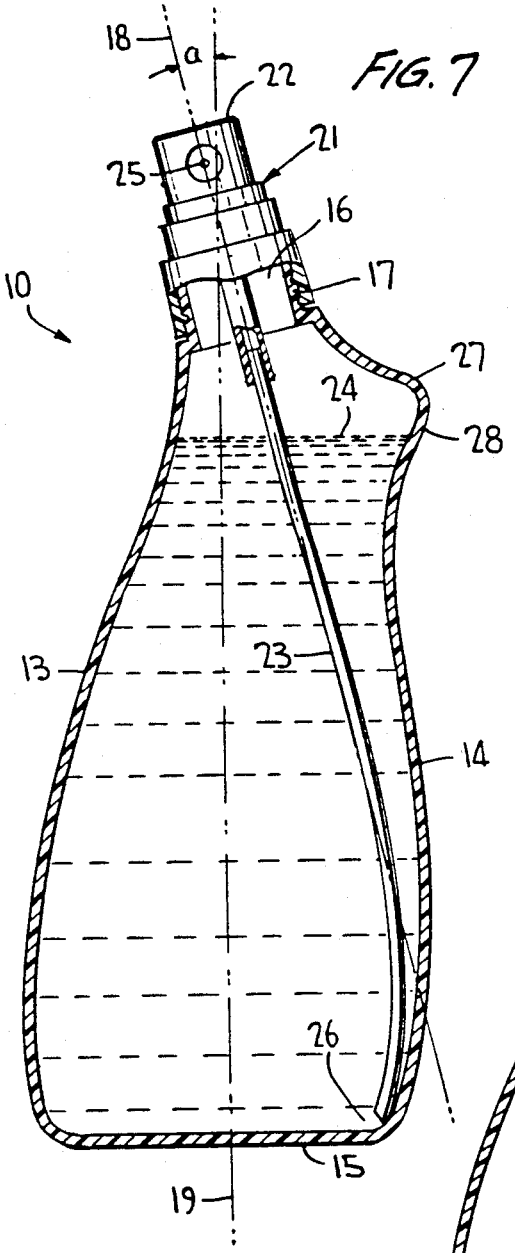
FIG. 7
FIG. 8
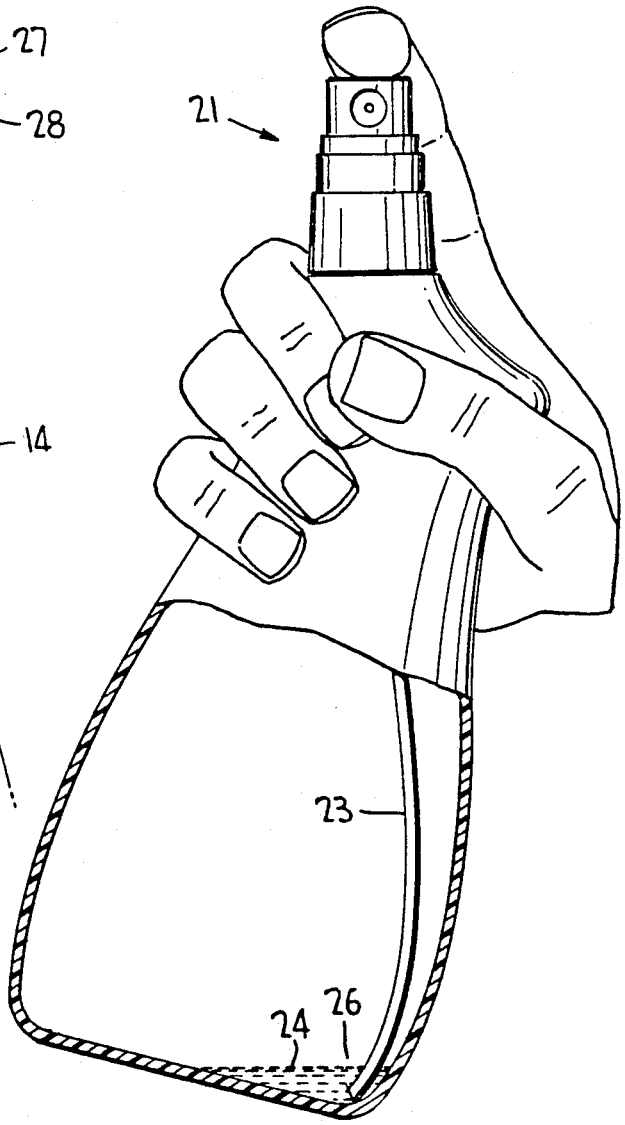

FINGERTIP SPRAYER MOUNTED ON AN ANGLED NECK CONTAINER

BACKGROUND OF THE INVENTION

This invention relates generally to a fingertip sprayer in combination with a container on which the sprayer is mounted, the container having an angled neck which orients the sprayer dip tube to assure a substantially complete evacuation of the container during the dispensing operation.

Fingertip sprayers are typically mounted on a container such that the central axis of the sprayer and its dip tube are coincident with the container central axis. The dip tube may be sufficiently long so as to bend in one direction along the bottom wall of the container for the purpose of hopefully extending below the liquid level of the container even when nearly empty so as to effect dispensing as much of the contents from the container as possible.

However, the direction in which the dip tube curls along the container bottom cannot be controlled during assembly such that even the tilting of the container during dispensing does not assure complete evacuation of the liquid remaining welled up within one corner of the container.

Moreover, the cylindrical contour of the container for dispensers of, for example, hair sprays, lotions, and the like does not readily lend itself to a secure and comfortable grasp of the container while dispensing. A form fitting container would materially improve upon the hand grasp of the operator and would provide a better support of the container when held.

SUMMARY OF THE INVENTION

It is therefore an object of the present invention to provide a fingertip dispenser of the pump variety having a dip tube, the container being structured so as to orient the dip tube to extend into an interior corner of the container which defines a well for the liquid contents during dispensing so as to assure substantially complete evacuation of the container.

In keeping with this objective, the container neck on which the dispenser is mounted has its axis lying at an acute angle to the central axis of the container, such that the dip tube lying along such acute axis extends into the interior corner of the container.

Another object of the present invention is to provide such a container as having an outward hump or bump located adjacent the container neck so as to define a shoulder for supporting the container on the operator's hand during the dispensing operation.

Other objects, advantages and novel features of the invention will become more apparent from the following detailed description of the invention when taken in conjunction with the accompanying drawings.

DETAILED DESCRIPTION OF THE DRAWINGS

FIG. 7 is a view similar to FIG. 1 showing the container and part of the mounted dispenser in cross-section; and FIG. 8 is a view similar to FIG. 7 showing the attitude of the container and dispenser during a dispensing operation.

DETAILED DESCRIPTION OF THE INVENTION

Figure 1:
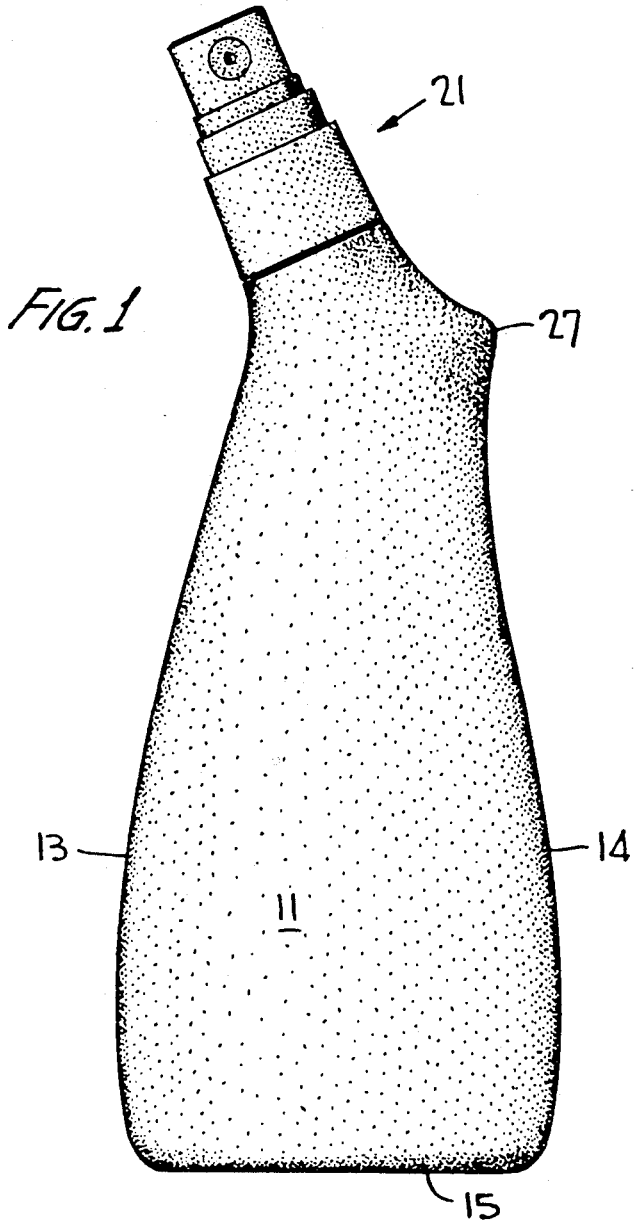
FIG. 1 is a front view of the dispenser mounted on the container according to the invention.
Figure 2:
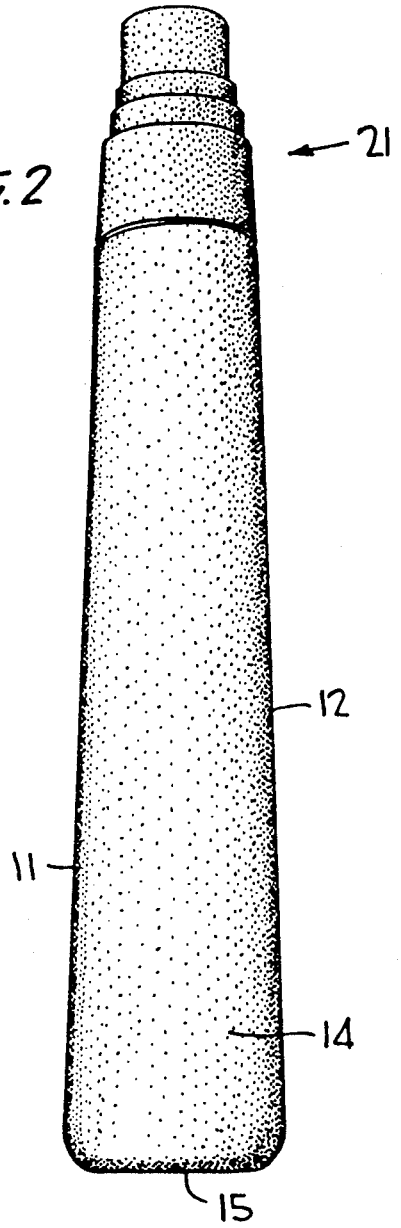
FIG. 2 is a right side view of FIG. 1.
Figure 3:
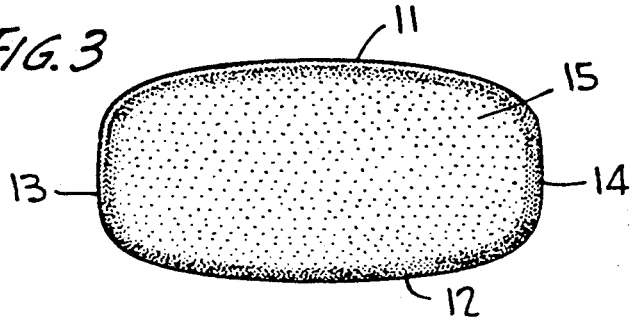
FIG. 3 is a bottom view of FIG. 1.
Figure 4:
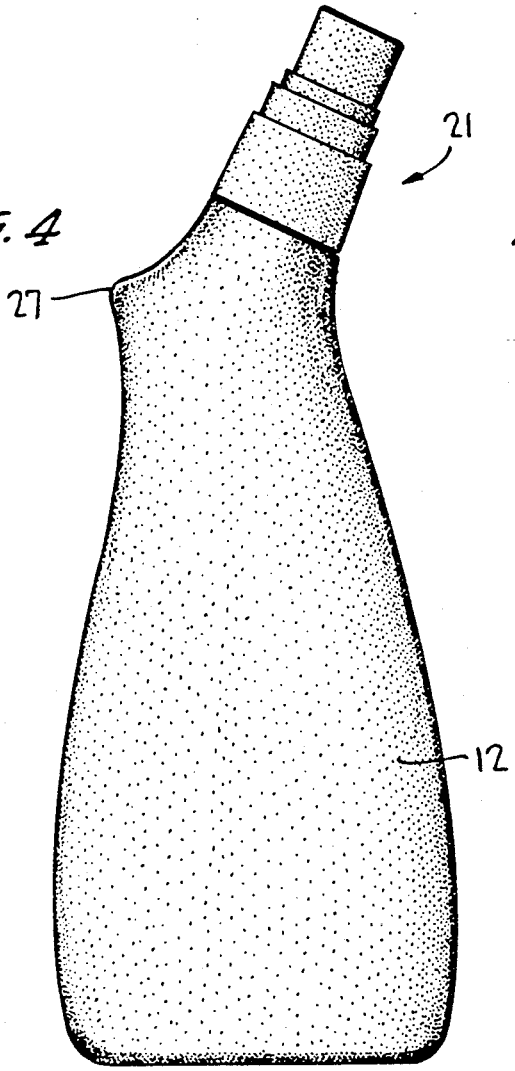
FIG. 4 is a rear view of FIG. 1.
Figure 5:
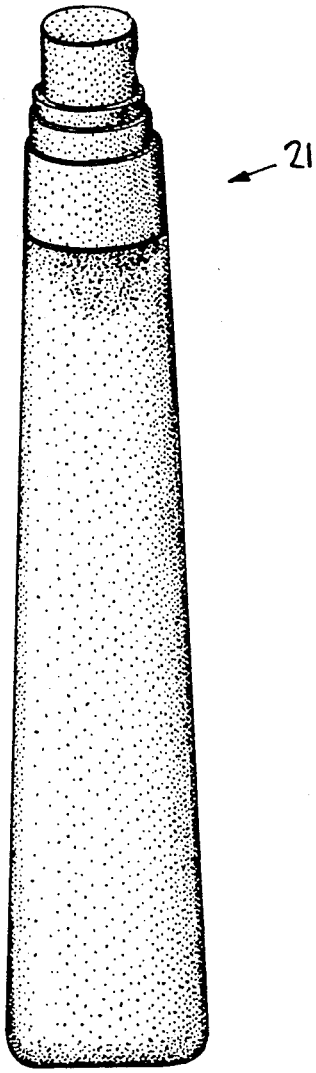
FIG. 5 is a left side view of FIG. 1.
Figure 6:
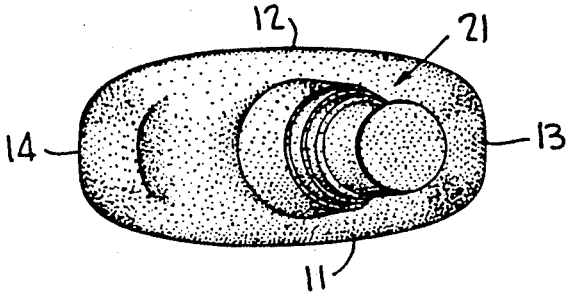
FIG. 6 is a top view of FIG. 1.

Turning now to the drawings wherein like reference characters refer to like and corresponding parts throughout the several views, the container according to the invention, generally designated 10, has a container wall which may comprise a pair of opposing side walls 11 and 12 and a pair of opposing end walls 13 and 14. The container has a flat bottom wall 15 and an opening 16 at its top formed by a container neck 17. As illustrated, the side walls are wider than the end walls so as to effect an essentially flattened container, although the container could be cylindrically shaped, or of oval shape, or the like, about departing from the invention.

The container neck is angle mounted such that its axis 18 lies at an acute angle a to the central axis 19 of the container. And, axis 18 may intersect wall 14 of the container, as more clearly shown in FIG. 7.

A fingertip pump sprayer 21 is mounted on the container neck by suitable means such as screw threads or the like, the sprayer being of the known variety forming no part of the invention. The sprayer may be of the type disclosed in U.S. Pat. No. 4,051,983, the entirety of which is specifically incorporated herein by reference.

The sprayer typically has a pump piston reciprocable in a pump cylinder upon depression of plunger head 22. The sprayer body suspends a dip tube 23 which extends into the container below the level of liquid 24 therein. Thus, the pump chamber, defined by the piston and cylinder, is filled with liquid as it is suctioned up through the dip tube during each suction stroke of the pump. Product is dispensed from the pump chamber through discharge orifice 25 during each pressure stroke upon plunger reciprocation.

The pump sprayer and its dip tube essentially lie along container neck axis and pump axis 18, the dip tube terminating in an interior corner 26 of the container formed between walls 14 and 15. Thus, the pump sprayer tilts in one direction relative to central axis 19 of the container.

When the sprayer is mounted on a container, the plunger head should be oriented so that the discharge orifice is located on the same side as wall 11.

In operation, the container is grasped by the hand of the operator shown in FIG. 8 in readiness for actuating the plunger head. As the container is held by the operator, it is automatically tilted so that axis 18 is substantially upright during the dispensing operation. As product is dispelled during dispensing, the level of the liquid eventually reaches that illustrated in FIG. 8, i.e., the liquid wells up in corner 26 when holding the container with axis 18 substantially upright. Since dip tube 23 extends into this well, it is assured that substantially all the liquid contents is expelled from the container during pumping.

In accordance with another feature of the invention, end wall 14 has an outwardly extending bump or hump 27 located adjacent neck 17, the hump providing a convenient shoulder 28. The opposing, end wall 13 is smoothly contoured so as to merge with the container neck. The pump extends in a direction opposite the tilt direction of the sprayer.

Thus, as the container is grasped by the operator, shown in FIG. 8, the nook of the hand conveniently bears against shoulder 28 which provides for a snug fit of the operator's hand as the fingers wrap around the smooth contour of end wall 13. Moreover, shoulder 28 provides for added support when holding the container. And, as most clearly shown in FIG. 7, the top of the tilted pump sprayer lies within the maximum outer contour of container 10. Likewise, the hump extension is such that it may be within this outer contour. The angled sprayer head and hump therefore do not interfere with packaging of the assembly which would otherwise bear against the sprayer head and the hump.

From the foregoing, it can be seen that a simple and economical yet highly effective pump dispenser assembly has been devised for assuring substantially complete evacuation of the container contents during dispensing without the need for any special anchoring of the dip tube for confining it to an interior corner such as 26. Also, the operator will always be assured that the dip tube extends into this interior corner or well without having to predict to the curl direction of the dip tube as in the prior art.

The angle relationship of the container neck and mounted sprayer automatically extends the dip tube into the lowest point within the container when held in a natural position with axis 18 substantially upright.

Obviously, many modifications and variations of the present invention are made possible in the light of the above teachings. For example, the pump sprayer can be of any suitable variety other than that shown and can be a spout dispenser, without departing from the invention. It is therefore to be understood that within the scope of the appended claims the invention may be practiced otherwise than as specifically described.

What is claimed:

1. A manually operated pump dispenser assembly comprising, a liquid container having a container wall, a flat bottom wall and a container opening formed by a container neck, the improvement wherein the axis of said container neck lies at an acute angle to the container central axis, said neck axis intersecting said container wall, and a fingertip dispenser mounted on said container neck over said opening, said dispenser having a dip tube lying along said container neck axis and extending into an interior corner of said container formed between said bottom wall and said container wall, whereby said interior corner forms a well from which substantially the entirety of the contents of said container is capable of being dispensed upon actuation of the dispenser while holding the container with said neck axis substantially upright.

2. The assembly according to claim 1, wherein said container wall has an outward hump adjacent said neck, said hump defining a shoulder for fitting against the hand of the operator while holding the container.

3. The assembly according to claim 1, wherein said dip tube bears against an inner surface of said container wall.

4. The assembly according to claim 2, wherein said container wall comprises a pair of opposing end walls having a predetermined width, and a pair of opposing side walls having a width greater than said predetermined width, said outward hump being formed on one of said end walls.

5. The assembly according to claim 4, wherein said dip tube bears against an inner surface of said one end wall.

6. A manually actuated pump dispenser assembly comprising, a liquid container having a container wall, a flat bottom wall and a container opening formed by a container neck, the improvement wherein the axis of said container neck lies at an acute angle to the container central axis, and a fingertip dispenser mounted on said container neck over said opening, said dispenser lying along said neck axis so as to tilt in one direction relative to said central axis, and said dispenser having a dip tube extending into said container, said container wall having an outward hump adjacent said neck extending in a direction opposite said one direction relative to said central axis, said hump defining a shoulder for fitting against the hand of the operator while holding the container with the neck axis substantially upright.

7. The assembly according to claim 6, wherein said dip tube terminates in an interior corner of said container formed between said bottom wall and said container wall, whereby said interior corner forms a wall from which substantially the entirety of the contents of the container is capable of being dispensed upon actuation of the dispenser while holding the container with said neck axis substantially upright.

8. The assembly according to claim 7, wherein said container wall comprises a pair of opposing end walls having a predetermined width, and a pair of opposing side walls having a width greater than said predetermined width, said outward hump being formed on one of said end walls.

* * * * *